US007517267B2

(12) United States Patent
Nesseth

(10) Patent No.: US 7,517,267 B2
(45) Date of Patent: Apr. 14, 2009

(54) FORWARD FACING ROWING ATTACHMENT WITH ROLLING SEAT

(76) Inventor: Michael J. Nesseth, 31595 Olinda Trail North, Lindstrom, MN (US) 55405

( * ) Notice: Subject to any disclaimer, the term of this patent is extended or adjusted under 35 U.S.C. 154(b) by 0 days.

(21) Appl. No.: 12/132,061

(22) Filed: Jun. 3, 2008

(65) Prior Publication Data

US 2008/0302293 A1 Dec. 11, 2008

Related U.S. Application Data

(60) Provisional application No. 60/933,197, filed on Jun. 5, 2007.

(51) Int. Cl.
*B63H 16/067* (2006.01)

(52) U.S. Cl. ..... 440/105; 440/102

(58) Field of Classification Search ..... 440/104, 440/105, 102, 103; 114/363, 347
See application file for complete search history.

(56) References Cited

U.S. PATENT DOCUMENTS 3,898,950 A * 8/1975 Martin ..... 440/105
4,649,852 A * 3/1987 Piantedosi ..... 114/363
4,846,460 A 7/1989 Duke ..... 272/72
4,940,227 A 7/1990 Coffey ..... 272/72
4,943,051 A 7/1990 Haskins et al. ..... 272/72
5,127,859 A 7/1992 Rantilla ..... 440/104
5,215,482 A 6/1993 Henry ..... 440/25
5,899,780 A * 5/1999 Robbins ..... 440/105
5,975,004 A 11/1999 Nesseth ..... 114/347
6,939,186 B1 9/2005 Kuckes ..... 440/104

* cited by examiner

*Primary Examiner*—Ed Swinehart
(74) *Attorney, Agent, or Firm*—Nawrocki, Rooney & Silvertson, P.A.

(57) ABSTRACT

A frame assembly forming a portion of a rowing accessory is to be mounted within a watercraft, to which frame assembly is attached a seat and oars. The frame assembly comprises first and second frame members each having the general shape of a winged U. First and second wing portions of each frame member extend outwardly from upper ends of the frame members. A track assembly has a beam attached to lower portions of the frame members at spaced apart connection points along the length of the beam. A seat assembly attaches to and slides along the beam. First and second hinge plates each have a first end attached at an outboard end of one wing portion of the first frame member, and a second end attached at an outboard end of one wing portion of the second frame member.

14 Claims, 12 Drawing Sheets

FORWARD FACING ROWING ATTACHMENT WITH ROLLING SEAT

This is a regular application filed under 35 U.S.C. §111(a) claiming priority under 35 U.S.C. §119(e)(1), of provisional application Ser. No. 60/933,197, filed Jun. 5, 2007, and incorporated herein by reference in its entirety.

BACKGROUND OF THE INVENTION

The present invention relates generally to watercraft and particularly, to canoes, rowboats, and other small water vessel. As is well known, canoes are traditionally propelled with paddles. Canoeists both propel and steer the canoe with the paddles. Since the paddling motion is to the side of the canoeist and only the arm muscles are involved, speed depends on good arm strength and an easily driven canoe. Canoeists face the bow of the canoe.

Small rowboats are typically propelled by pairs of oars that pivot in oarlocks fastened to the gunwales (upper edges) of the rowboat hulls. The oarlocks each have a vertical axis pivot that allows a rower to apply force to the oars in a substantially horizontal plane with the oar blades in the water and to lift the oars at the end of the stroke to move the oars forward for another stroke. Differential speed in rowing one or the other of the two oars in a pair provides steering. Again, arm strength is important for good speed in a typical small rowboat.

For a long time, rowers have faced the stem of the rowboat because much more energy is available from pulling than from pushing on the oar handles. Facing the stern is inconvenient, since the rower must look over his or her shoulder to see where the craft is heading and what obstructions are present.

Crew racing is a type of rowing competition using light narrow shells as the rowing craft. Shells usually have sliding seats and fixed footrests which allow the rowers to use their larger leg muscles as well as their arm muscles to drive the oars. Anywhere from one to eight rowers using either one or two oars each, propels these shells at quite high speeds. Crews in shells almost always face the stern of the craft.

The present invention is an improvement to an accessory for a canoe or rowboat disclosed in U.S. Pat. No. 5,975,004 issued to the applicant for this application. The '004 patent is incorporated by reference into this application.

The invention disclosed in the '004 patent is a rowing accessory having a frame that attaches to the gunwales of the canoe or rowboat. The frame has a suspended seat and a rowing mechanism that allows the rower to face the bow of the rowboat and still pull rather than push on the oars, which are mounted on opposite sides of the frame. The seat of the '004 patent is stationary.

SUMMARY OF THE INVENTION

A frame assembly forming a portion of a rowing accessory is to be mounted within a watercraft, to which frame assembly is attached a seat and oars. The frame assembly comprises first and second frame members each having the general shape of a winged U. First and second wing portions of each frame member extend outwardly to form outboard ends of the frame members. A track assembly has a beam attached to lower portions of the frame members at spaced apart connection points along the length of the beam. A seat assembly attaches to the beam and has a seat mounted on a mechanism allowing the seat to slide along the beam. First and second connector plates each have a first end attached at an outboard end of one wing portion of the first frame member, and a second end attached at an outboard end of one wing portion of the second frame member.

DESCRIPTION OF THE PREFERRED EMBODIMENTS

Figure 1:
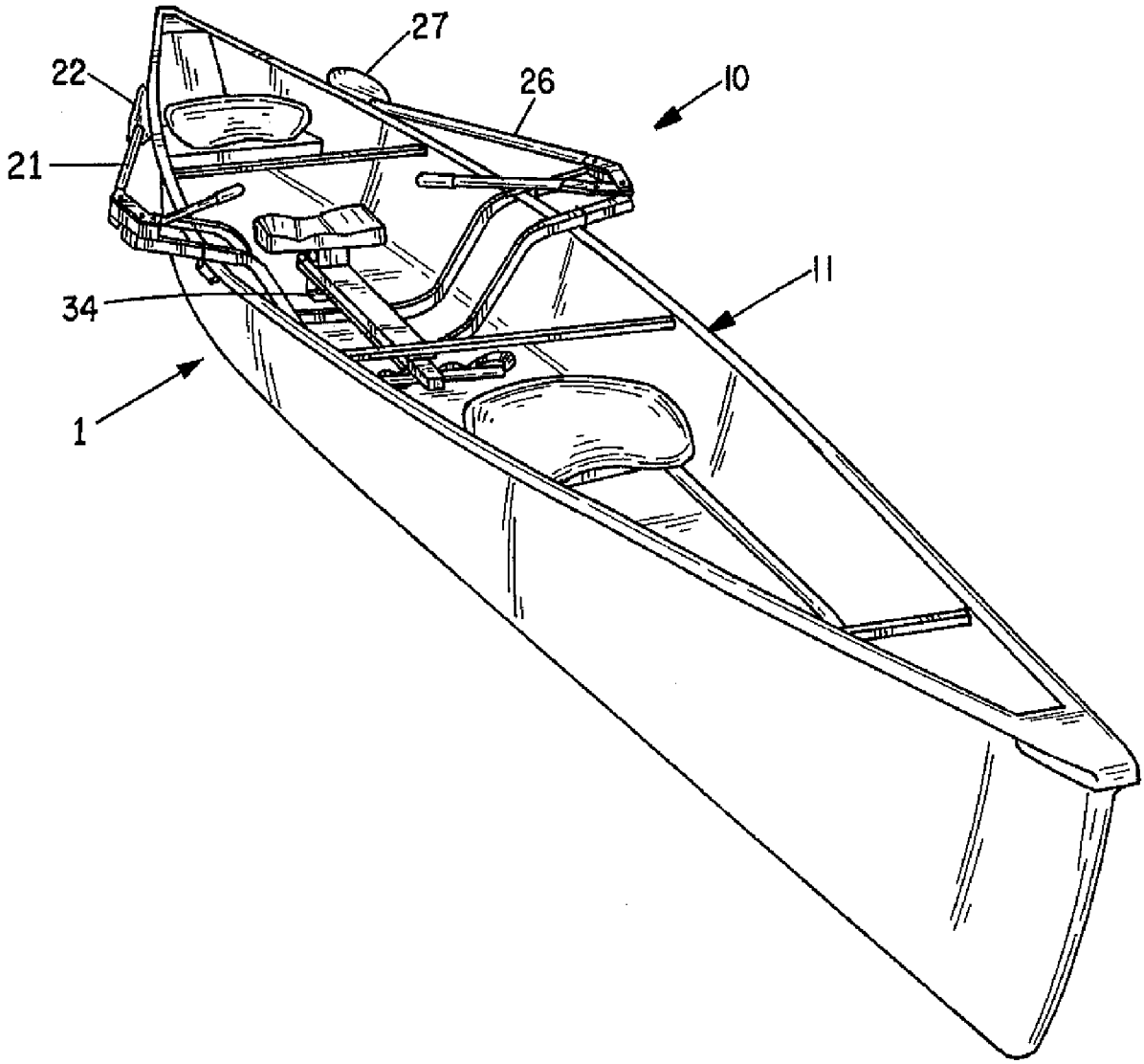
FIG. 1 is a perspective view of a forward-facing rowing accessory with the frame assembly of the present invention mounted in a canoe.
Figure 2:
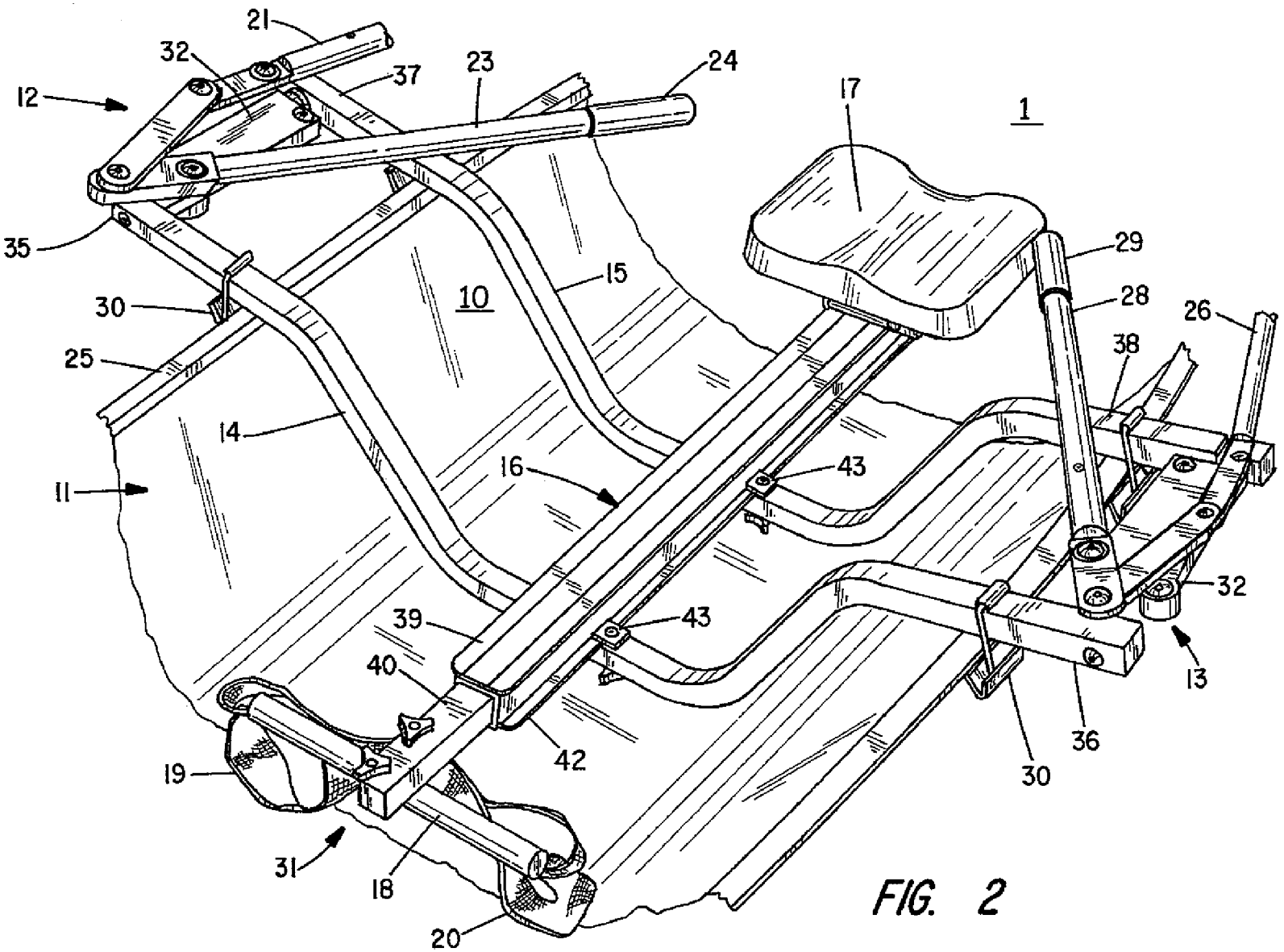
FIG. 2 is an enlarged perspective view of the accessory shown in FIG. 1.

FIGS. 1 and 2 show the present invention as a frame assembly 10 that is particularly useful as a component of a forward-facing rowing accessory 1 that can be retrofitted into an existing canoe 11 as shown, or into other small watercraft typically propelled by a human.

Figure 3:
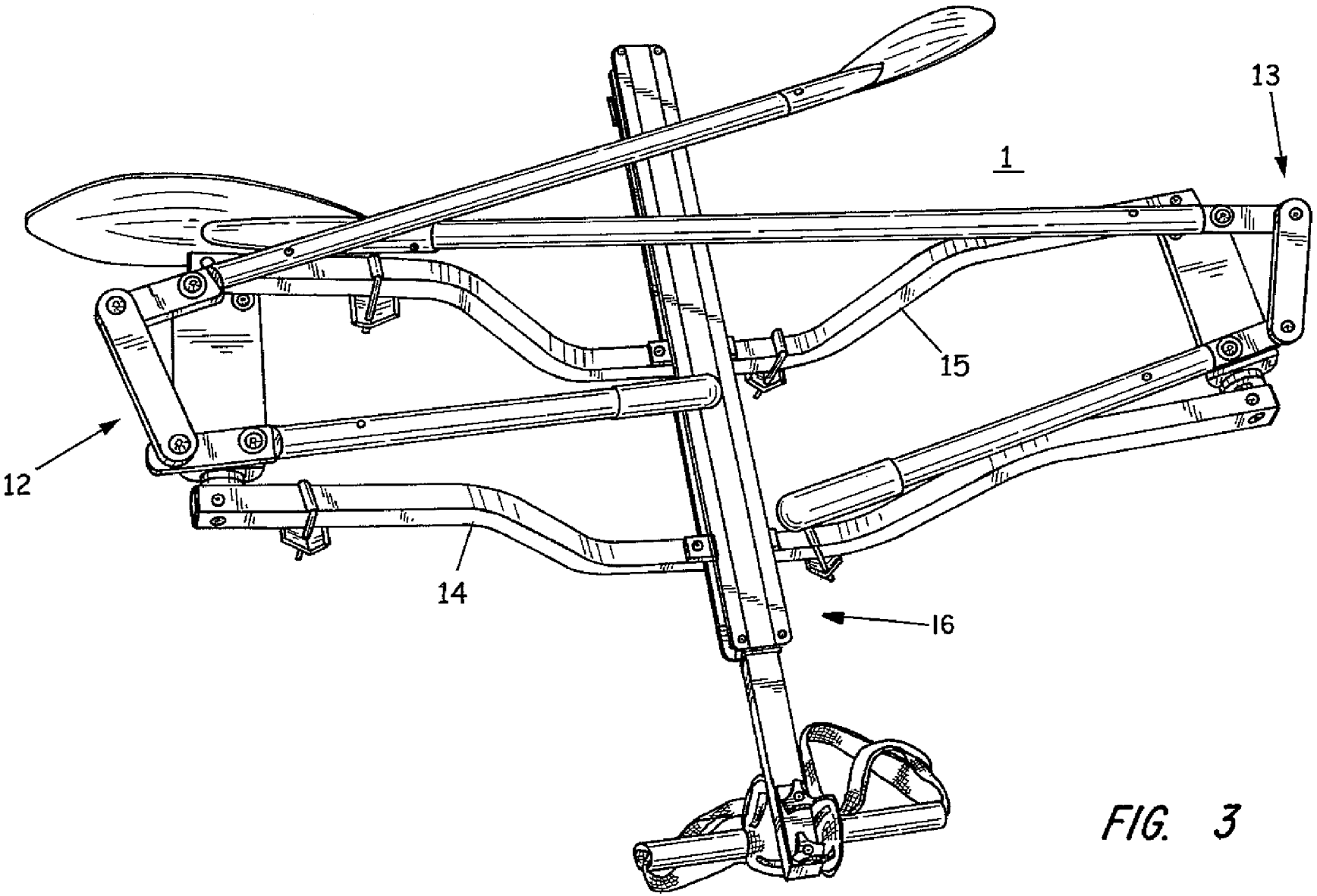
FIG. 3 is a perspective view of the accessory when ready for installation in a watercraft.

The frame assembly 10 of the present invention includes first and second frame members 14 and 15, a track assembly 16, a seat assembly 17 that smoothly slides on track assembly 16, and a telescoping footrest 31. FIGS. 1-3 show these components (absent seat assembly 17 in FIG. 3) in assembled form for use in a canoe 11.

Figure 4:
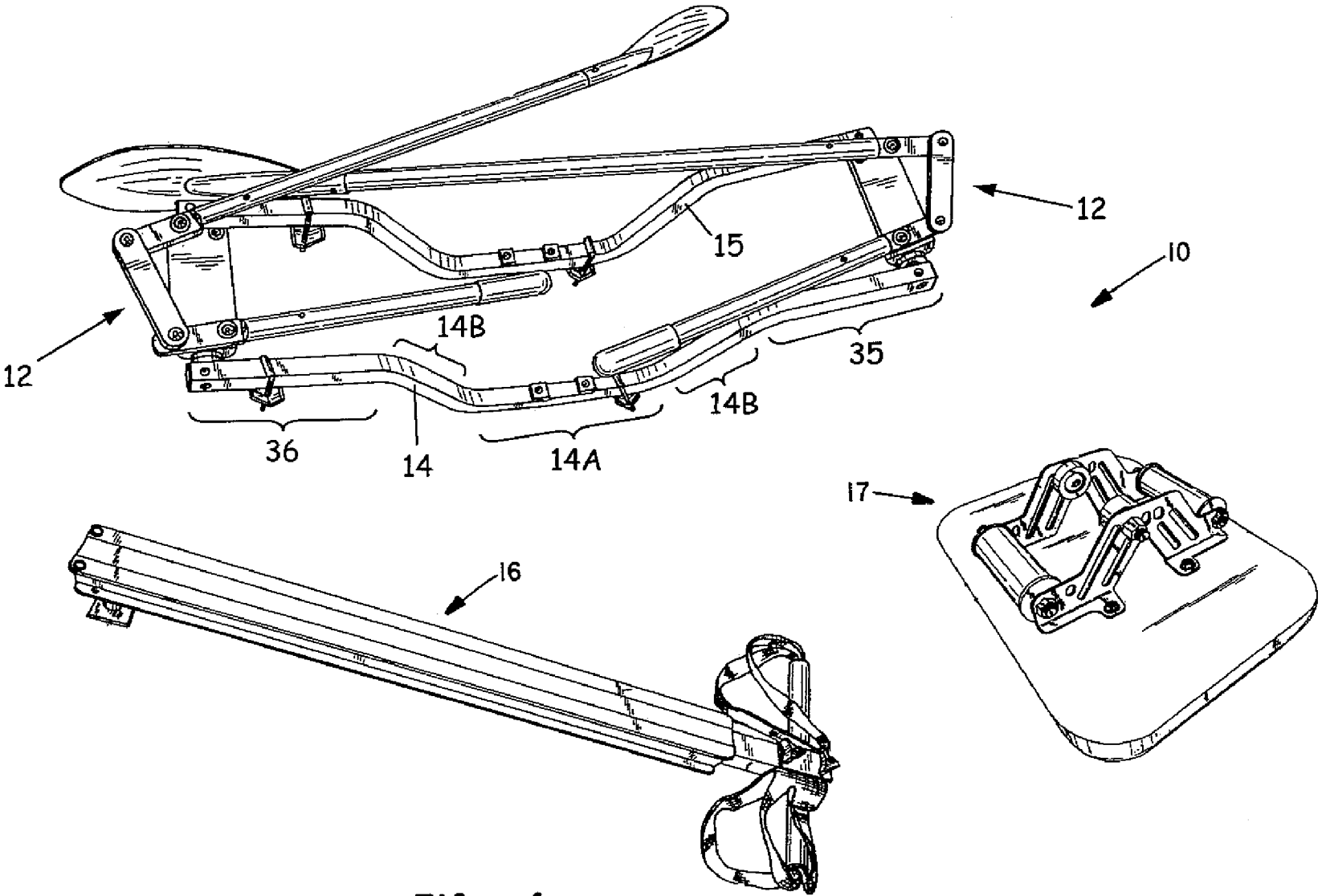
FIG. 4 is a perspective view of the accessory when disassembled.

FIG. 3 shows the accessory 1 with the seat assembly 17 detached from track assembly 16 and the individual oar mechanisms 12 and 13 attached to the frame members 14 and 15. FIG. 4 shows separate frames members 14 and 15 attached to the oar assemblies 12, and with seat assembly 17 and track assembly 16 detached from the frame members 14 and 15.

The design of frame assembly 10 provides a number of advantages. The position of seat assembly 17 and track assembly 16 is near the bottom of the watercraft to improve stability. Particularly in the case of a canoe 11 comprising the watercraft, positioning the seat assembly 17 near the bottom of the hull is important for good stability. Secondly, positioning the seat assembly 17 near the bottom of the hull places the rower's shoulders more nearly in line with the oar mechanisms 12 and 13, allows more comfortable force transfer from the rower to mechanisms 12 and 13.

The right and left oar mechanisms 12 and 13 positions are above the sides of the canoe 11 and extend therefrom. FIGS. 5-8 show various views and positions of the oar mechanisms 12 and 13.

Frame members 14 and 15 are preferably identical in shape and each have the form of a "winged U". Each frame member 14, 15 may be formed from a continuous section of 1.25 in. square tube aluminum stock having a wall thickness of 0.09 in. T-5 is one type of aluminum alloy suitable for use as members 14, 15 due to the fact that T-5 alloy is relatively easy to bend and yet has substantial mechanical strength. Each frame member 14, 15 is planar, that is, will lie flat on a flat surface. The dimensions of each frame member 14, 15 allows assembly 10 to span the width of a canoe 11 or other similar watercraft, and to allow the section 14A (FIG. 4) to rest on or near the bottom of the watercraft FIG. 4 shows frame member 14 as having a generally flat bottom portion 14A that transitions to first and second arm portions 14B to collectively form a lower U portion of frame member 14. Arm portions 14B extend upwardly and outwardly from opposite ends of bottom portion 14A. First and second wing portions 35, 36 in turn extend outwardly from the upper ends of the first and second arm portions 14B respectively, from which the term "winged U" arises. The frame members 14 and 15 have various holes through which machine screws pass for fastening to the oar mechanisms 12, 13 and the track assembly 17.

Figure 9:
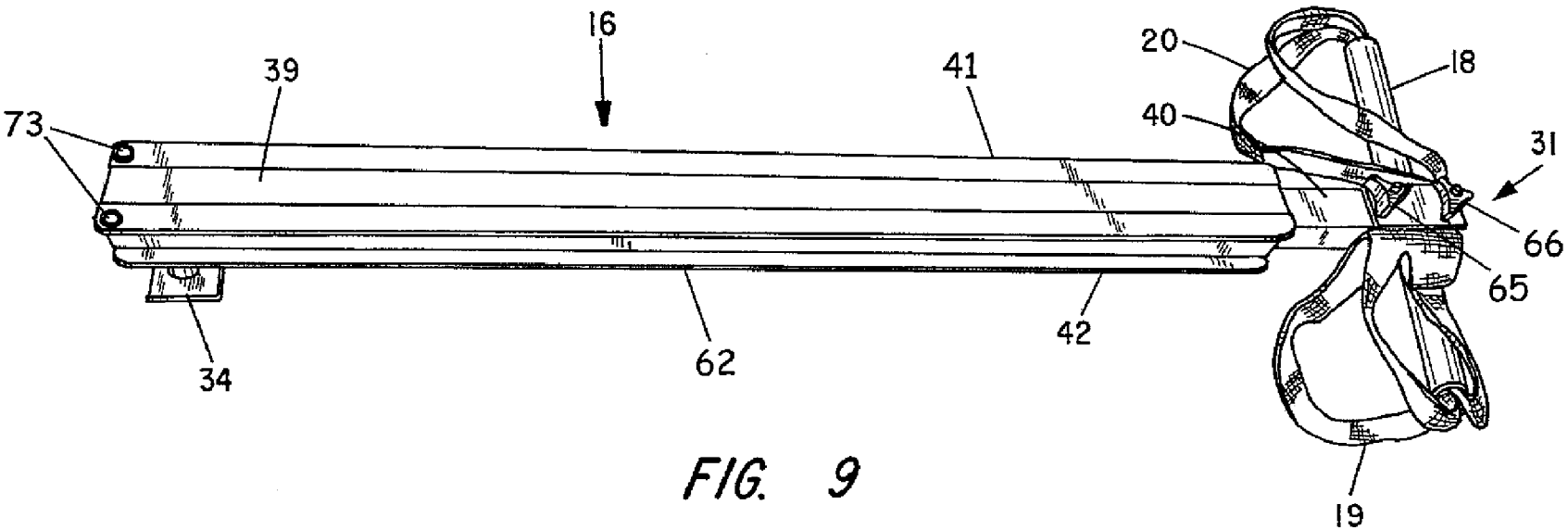
FIG. 9 is a perspective view of the track assembly with telescoping footrest of the assembly of the invention.
Figure 10:
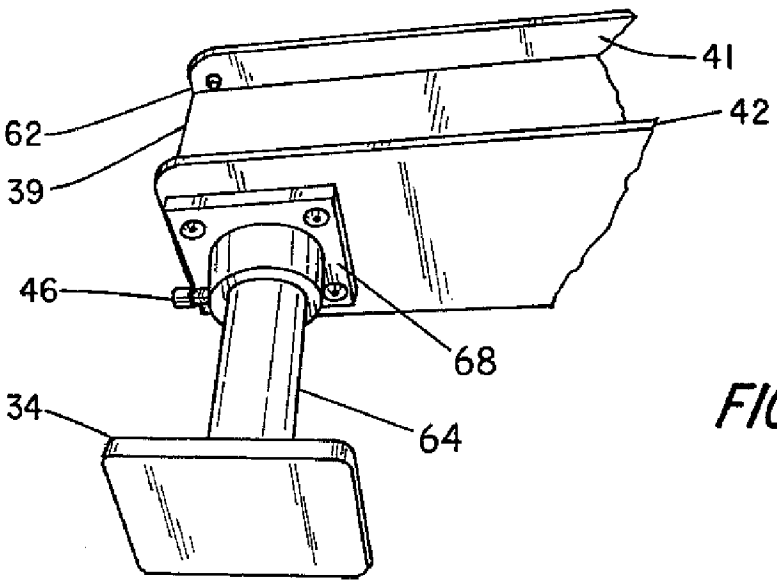
FIG. 10 is an enlarged perspective view of one end of the track assembly of FIG. 9.
Figure 11:
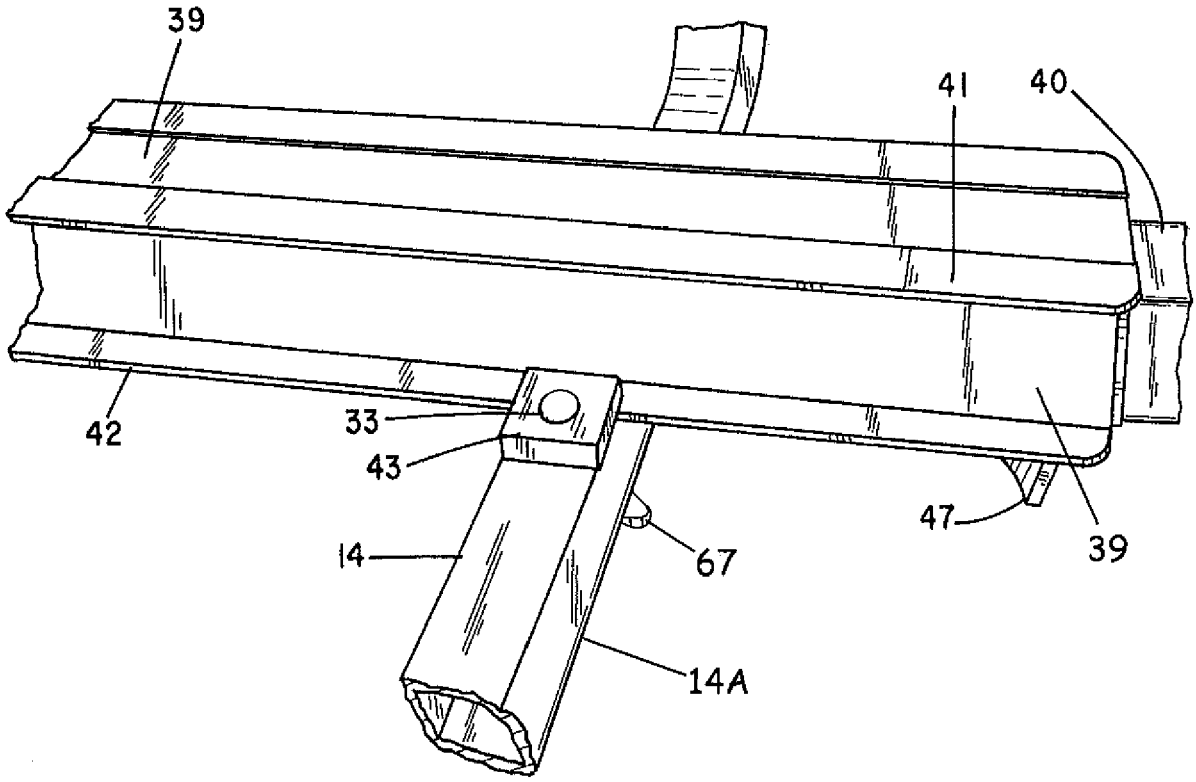
FIG. 11 is an enlarged perspective view of the track assembly of FIG. 9.

The dimensions of frame members 14, 15 should place bottom portion 14A slightly above the floor of typical canoes and watercraft when the wing portions are resting on the watercraft gunnels. Thus, frame members 14, 15 support a part of the weight of frame assembly 10, and foot FIGS. 9-11 show details of track assembly 16. Box beam 62 has a tubular web section 39 with a rectangular cross section. The upper and lower walls of web section 39 carry respectively, an upper flange 41 and a lower flange 42. Flanges 41 and 42 cooperate with web section 39 to form a type of I-beam construction for beam 62 that provides substantial strength and rigidity both in bending and torsion.

FIG. 10 shows a first end of lower flange 42 with a fitting 68 for mounting an adjustable foot or support element 34. Foot element 34 has a tubular leg 64 that fits into fitting 68 to project downwardly from flange 42. A set screw 46 in fitting 68 clamps leg 64 in any position required by the depth of the canoe 11 and the configuration of the canoe 11 bottom. This design distributes the loads and stresses on canoe 11 and frame assembly 10. Stops 73 prevent seat assembly 17 from rolling off track assembly 16.

Figure 12:
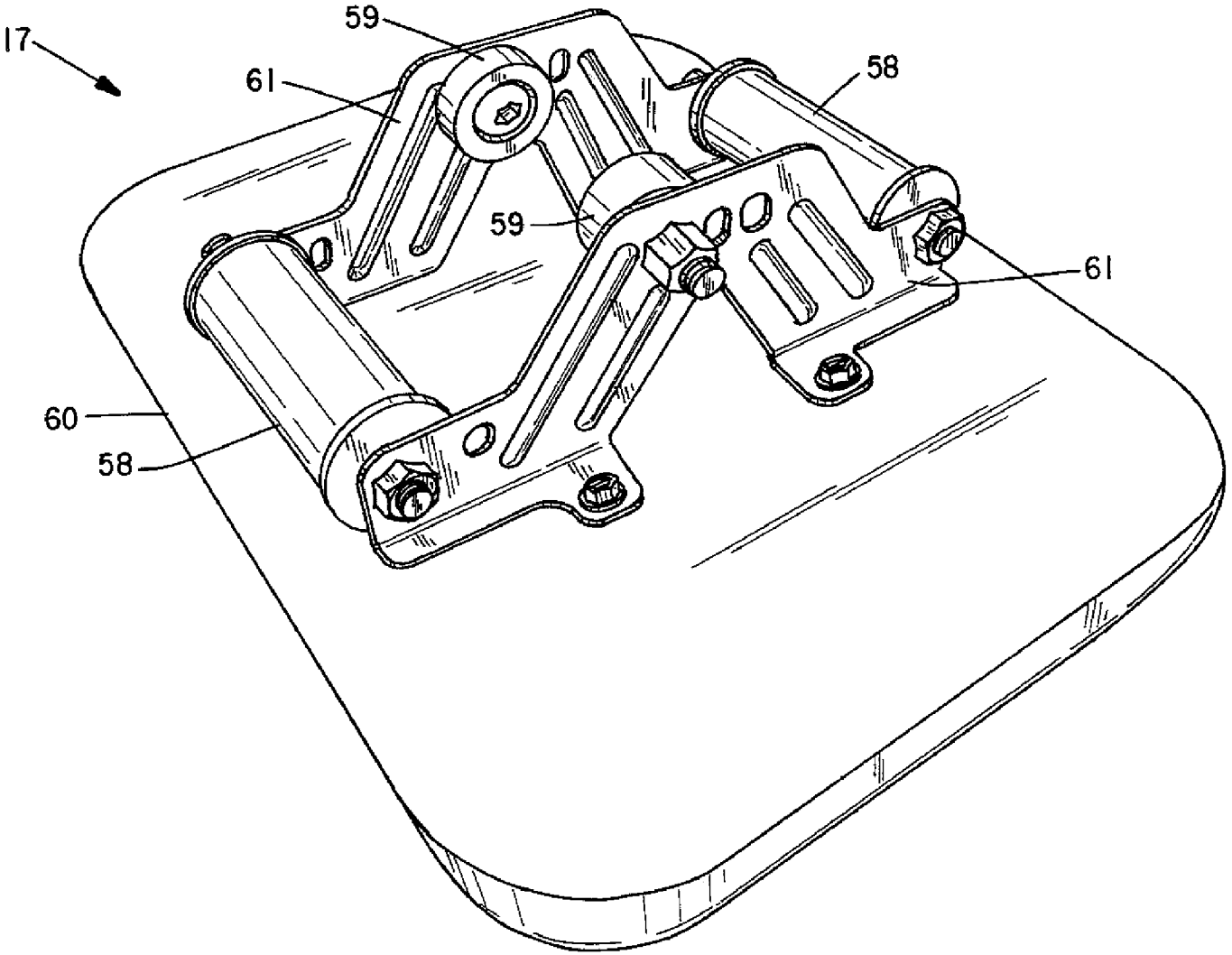
FIG. 12 is a perspective view of the seat assembly of the invention.

FIGS. 4 and 12 show seat assembly 17 inverted to reveal its construction. Assembly 17 includes a seat 60 for supporting a rower, and upper rollers 58 that in use, rest and roll on flange 41 of track assembly 16. Wheels 59 engage the lower surface of flange 41 to retain seat assembly on beam 62. Rollers 58 preferably have annular flanges at the ends thereof to maintain the alignment of rollers 58 with flange 41, although other alignment features are possible as well.

Track assembly 16 includes an adjustable footrest assembly 31 having a footrest crosspiece 18 attached to a bar or tube 40. Bar 40 telescopes closely into web section 39. A knob 47 (FIG. 11) operates a setscrew that clamps bar 40 within web section 39 in a position suitable for the rower. Toe straps 19 and 20 allow the rower to easily slide seat assembly 17 forward to begin a stroke. Knobs 65 and 66 allow the rower to adjust the size of straps 19 and 20 to accommodate the rower's shoe size. One may also use other closure and adjustment structures, for example a hook and loop (Velcro®) termination of toe straps 19 and 20.

FIGS. 2 and 11 show how plates 43 attach track assembly 16 to frame members 14 and 15. Knobs 67 operate machine screws 33 that engage and compress four clamps 43 against flange 42. Plates 43 preferably contact flange 42 at spaced apart connection points along the length of the beam 62 substantially equal to the length of connector plates 43 to hold frame members 14 and 15 in substantially parallel relationship.

This means of connecting track assembly 16 to frame members 14, 15 provides significant advantages over other types of attachments. In the first place these clamps 43 allow for rapid assembly and disassembly of frame assembly 10—requiring tightening only four machine screws. Assembled, frame assembly 10 is extremely bulky, and best transported unassembled. Secondly, the clamped attachment feature allows positioning of track assembly 16 relative to oar mechanisms 12, 13 to accommodate rowers of all sizes.

Frame assembly 10 is particularly well suited for use with a forward-facing rowing system, but is also suitable for use with conventional rowing systems. FIGS. 1 and 2 show how outwardly extending wing portions 35-38 of the U-shaped frame members 14 and 15 support attachment plates 32 for rotation about shaft 51. Plates 32 mount the "forward facing" oar mechanisms 12 and 13. The "forward facing" oar mechanisms 12 and 13 are fastened on opposing sides of the canoe between wing portions 35 and 37 and wing portions 36 and 38, respectively.

U-shaped clamps 30 secure the frame members 14 and 15 to flanges on the gunnels of canoe 11. Forward facing oar mechanism 12 mounts between the wing 35 of frame member 14 and wing 37 of frame member 15 to operate blade 22 through arm 21. Forward facing oar mechanism 13 mounts between the wing 36 of frame member 14 and wing 8 of member 15 to operate blade 27 through arm 26.

Figure 13:
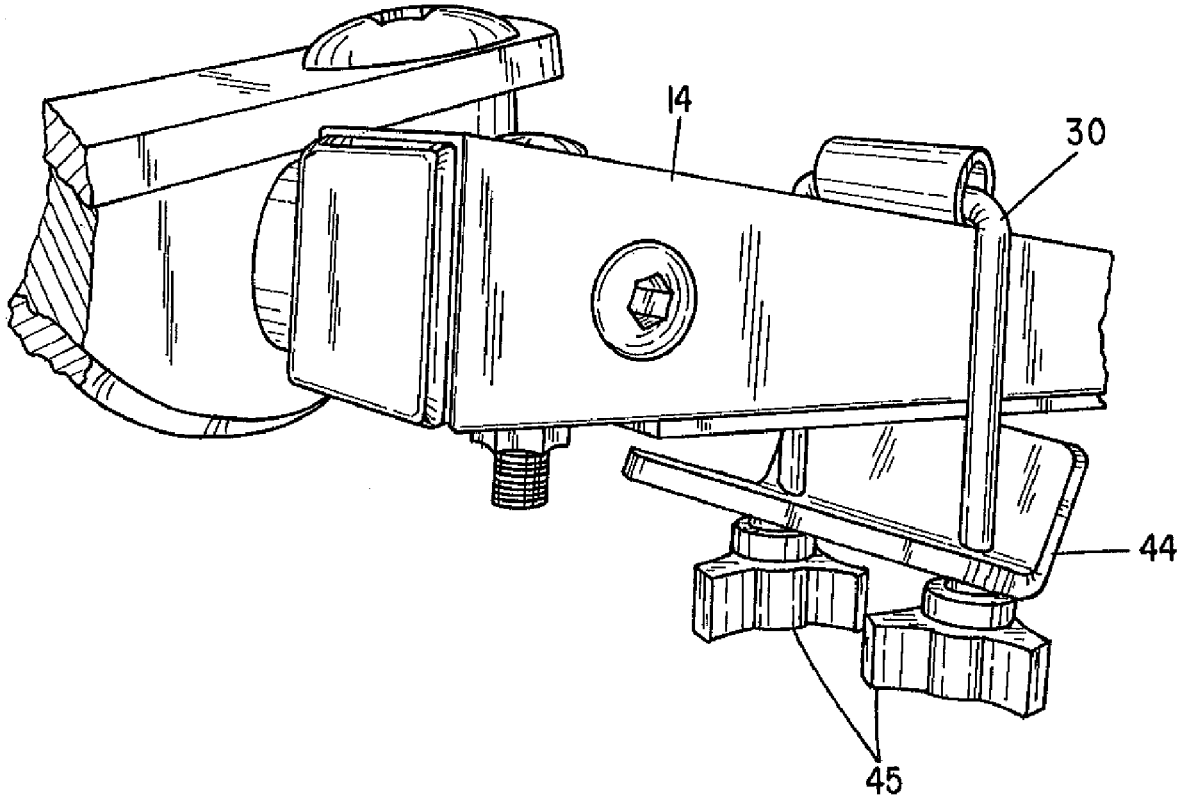
FIG. 13 is an enlarged perspective view of the means to attach the assembly to a canoe.

As shown in FIG. 13, U-shaped clamp 30 has nuts 45 at threaded ends thereof and an L-shaped plate 44. The design of L-shaped plate 44 allows it to fit under the flange of a canoe gunnel to secure the assembly 10 to the sides of a canoe 11 by tightening nuts 45.

As shown in FIGS. 1 and 2 of the present application, oar mechanism 12 has arm 21 having oar blade 22 at its terminal end and oar mechanism 13 has arm 26 with oar blade 27 at its terminal end. Oar mechanisms 12 and 13 have handle portions 23 and 28 having terminal handle ends 24 and 29, respectively.

A rower pulls on handles 24 and 29 to operate the force conversion mechanism of each assembly, and to make the oar portions 21 and 26 move opposite to that of traditional oars, thereby making the watercraft move forward rather than backward.

As shown in FIGS. 5-8, oar mechanism 13 mounts between frame members 14 and 15. Connector or hinge plate 32 rotates on shaft 51. Shaft 51 extends between frame members 14 and 15 and swivels in bearings carried in frame members 14 and 15. Shaft collar 52 mounts around shaft 51. Shaft pin 63 (FIG. 8) extends through frame members 14 and 15 and the ends of shaft 51 to stabilize the shaft 51.

Figure 5:
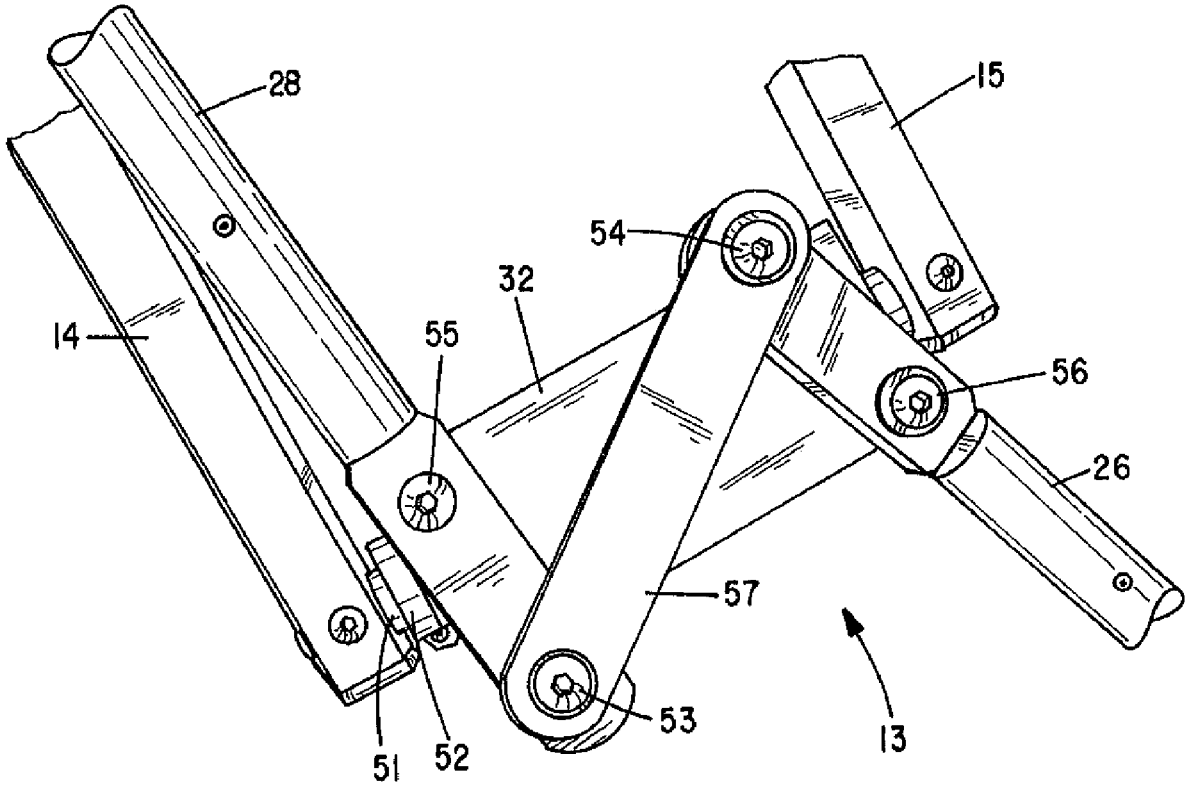
FIGS. 5-8 are perspective views of various views and positions of a force conversion linkage useful with the invention.
Figure 6:
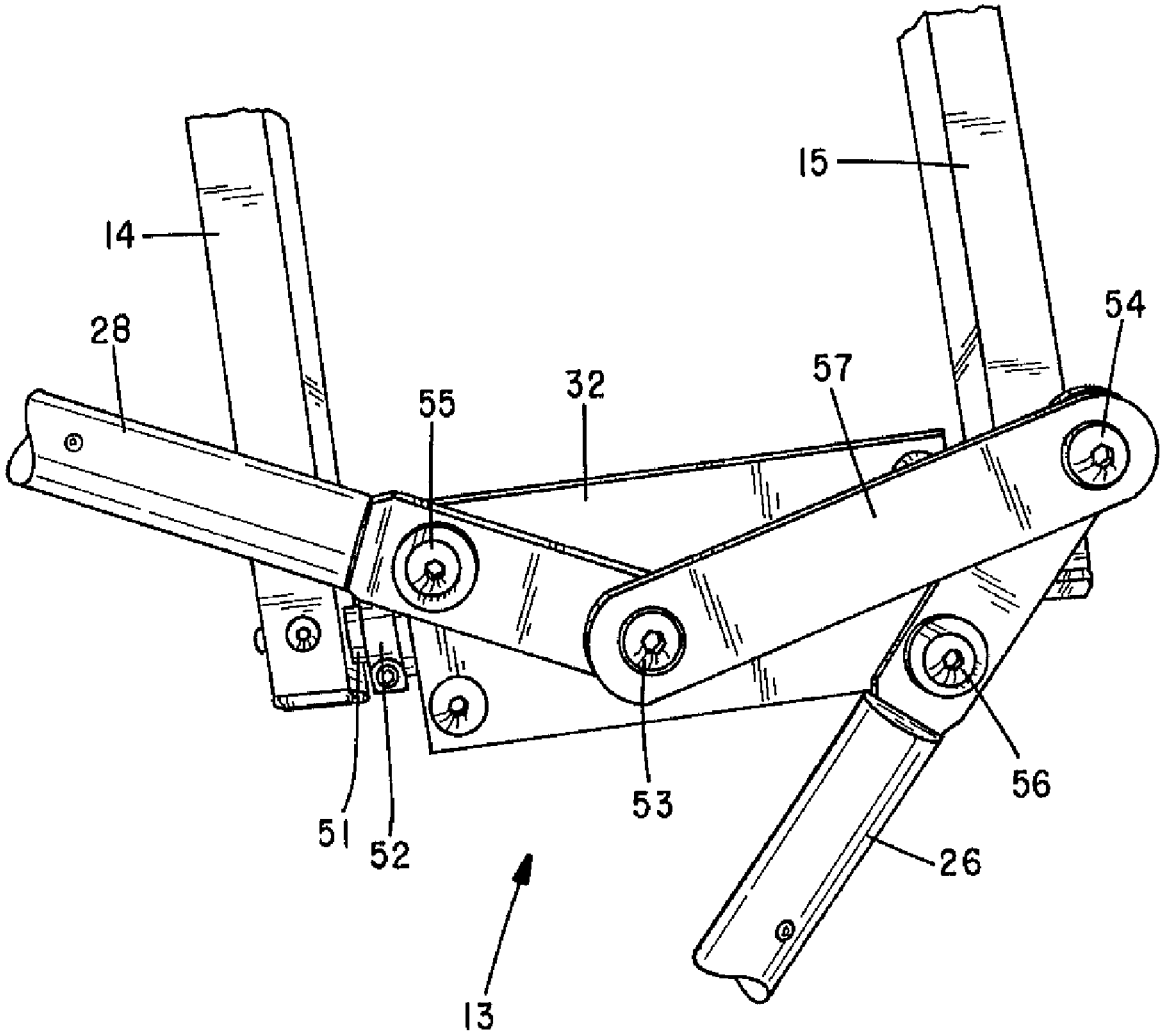
Figure 7:
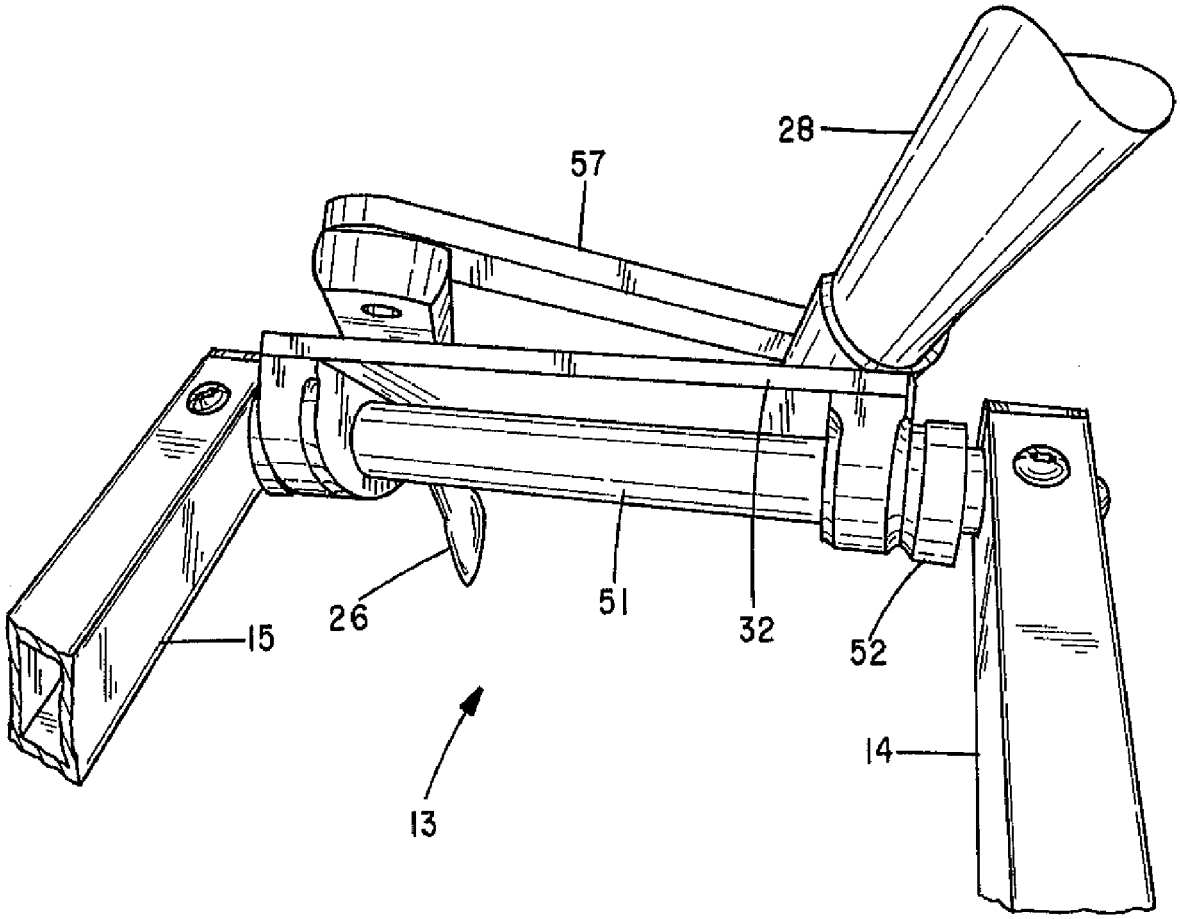

Conversion bar or link 57 connects oar arm 26 and handle arm 28. Fulcrums 54 and 53 at the ends of oar arm 26 and handle arm 28 respectively. Pivots 55 and 56 attach handle arm 28 and oar arm 26 respectively to plate 32. The end of handle arm 28 may contains a slot or additional hole (not shown) to allow changing the position of fulcrum 53 to thereby adjust oar blade speed. Each pivot point and fulcrum preferably has at least one stainless steel ball bearing or similar bearing composition. FIGS. 5 and 6 are top views of force conversion assembly 13 and FIG. 7 is a side view of force conversion assembly 13, as seen from the inside of a boat.

Figure 8:
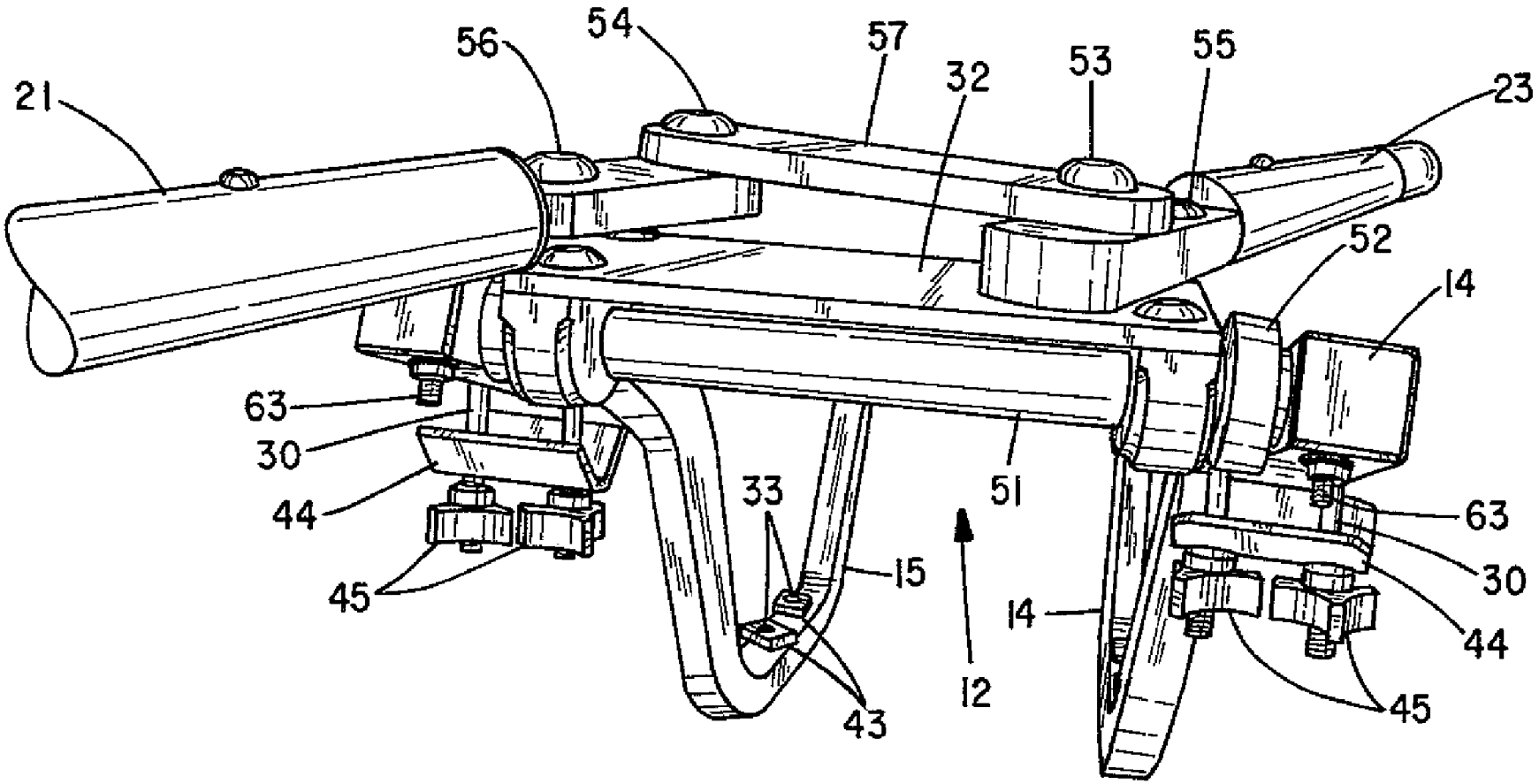

FIG. 8 shows the exterior of oar mechanism 12, which is similar to assembly 13. Clamps 43 are shown in FIG. 8 on the lower horizontal portion of frame member 15. FIG. 8 also shows the U-shaped clamps 30, as discussed above and further shown in FIG. 13.

As many changes are possible to the forward facing rowing attachment with sliding seat for a small watercraft embodiments of this invention utilizing the teachings thereof, the descriptions above, and the accompanying drawing should be interpreted in the illustrative sense only.

The claimed subject matter is:

1. A frame assembly to form a portion of a rowing accessory for mounting within a watercraft, and to which may be attached a seat and oars, comprising:

a) first and second frame members each having the general shape of a winged U, each frame member having a lower U portion having upwardly extending first and second arm portions, and first and second wing portions extending outwardly from upper ends of the first and second arm portions;

b) a track assembly having an elongate beam, said elongate beam for positioning over and attaching to each lower U portion of said frame members at spaced apart connection points along the length of the beam;

c) a seat assembly attached to and sliding along said elongate beam; and d) first and second connector plates, each having a first end attached at an outboard end of one wing portion of the first frame member, and a second end attached at an outboard end of one wing portion of the second frame member.

2. The frame assembly of claim 1, wherein the spaced apart points along the length of said beam have substantially equal spacing.

3. The frame assembly of claim 2, wherein the shape of each frame member allows said frame member to lie substantially flat on a flat surface.

4. The frame assembly of claim 3, wherein each connector plate includes a feature structured to mount an oar.

5. The frame assembly of claim 4, wherein said track assembly includes at an end of the beam, a foot for supporting the track.

6. The frame assembly of claim 5, wherein the foot includes a structure for adjusting the length of the foot.

7. The frame assembly of claim 6 including a footrest attached to a first end of the beam and adjacent to at least one frame member.

8. The frame assembly of claim 7, wherein the beam attaches adjacent to a first end thereof to the frame members, wherein the first end of the beam has a tubular construction, and wherein the footrest includes an elongate bar sized to telescopically fit within the first end of the beam.

9. The frame assembly of claim 1 including a footrest attached to the beam and adjacent to at least one frame member.

10. The frame assembly of claim 9, wherein the beam is attached adjacent to a first end thereof to the frame members, wherein the first end of the track has a tubular construction, and wherein the footrest includes an elongate support sized to telescopically fit within the first end of the track.

11. The frame assembly of claim 10, wherein the beam is tubular, and has an upper flange with upper and lower surfaces.

12. The frame assembly of claim 11, wherein the seat assembly includes a first roller rolling on the upper surface of the upper flange, and a second roller rolling on the lower surface of the upper flange.

13. The frame assembly of claim 11, wherein the beam further includes a lower flange, and further comprising clamps connected to the beam and compressing the lower flange against the frame members.

14. The frame assembly of claim 13, including at least four clamps.

* * * * *